US012104341B2

(12) United States Patent
Særvoll

(10) Patent No.: US 12,104,341 B2
(45) Date of Patent: Oct. 1, 2024

(54) GROUND-ANCHORED FOUNDATION FOR A MOBILE FLOOD PROTECTION ARRANGEMENT AND FLOOD PROTECTION ARRANGEMENT FOR ATTACHMENT TO A GROUND-ANCHORED FOUNDATION, AS WELL AS METHOD FOR ANCHORING A MOBILE FLOOD PROTECTION ARRANGEMENT

(71) Applicant: Arnfinn Særvoll

(72) Inventor: Arnfinn Særvoll, Bodø (NO)

(73) Assignee: Arnfinn Særvoll, Bodø (NO)

( * ) Notice: Subject to any disclaimer, the term of this patent is extended or adjusted under 35 U.S.C. 154(b) by 814 days.

(21) Appl. No.: 17/292,894

(22) PCT Filed: Nov. 6, 2019

(86) PCT No.: PCT/NO2019/050243
§ 371 (c)(1),
(2) Date: May 11, 2021

(87) PCT Pub. No.: WO2020/101502
PCT Pub. Date: May 22, 2020

(65) Prior Publication Data

US 2021/0395969 A1 Dec. 23, 2021

(30) Foreign Application Priority Data

Nov. 13, 2018 (NO) ..... 20181452

(51) Int. Cl.
*E02B 3/10* (2006.01)
*E02D 5/80* (2006.01)
(Continued)

(52) U.S. Cl.
CPC ..... *E02B 3/106* (2013.01); *E02D 5/80* (2013.01); *E02D 27/14* (2013.01); *E04H 12/22* (2013.01); *E04H 17/08* (2013.01); *E04H 17/22* (2013.01)

(58) Field of Classification Search
CPC . E02B 3/106; E02B 3/102; E02B 3/10; E02D 5/80; E02D 27/14; E04H 12/22; E04H 17/08; E04H 17/22; E06B 2009/007
See application file for complete search history.

(56) References Cited

U.S. PATENT DOCUMENTS 360,187 A * 3/1887 Wickers et al. .... E04H 12/2269 52/298
528,109 A * 10/1894 Pratt ..... E04H 17/08 256/DIG. 1
(Continued)

FOREIGN PATENT DOCUMENTS

AT 505 404 A4 1/2009
AU 663043 B3 9/1995
(Continued)

OTHER PUBLICATIONS

International Bureau, International Search Report in International Application No. National Phase of PCT/NO2019/050243, mailed Jan. 14, 2020.
(Continued)

*Primary Examiner* — Edwin J Toledo-Duran
(74) *Attorney, Agent, or Firm* — Leydig, Voit & Mayer, Ltd.

(57) ABSTRACT

A ground-anchored foundation for a mobile flood protection arrangement is provided, wherein the ground-anchored foundation comprises at least one bottom anchor cylinder, wherein the at least one cylinder is attached to a plate, the plate being centered to the at least one cylinder, wherein the
(Continued)

plate comprises a mounting hole adapted for pivotally attaching a receiver part to the mobile flood protection arrangement.

8 Claims, 3 Drawing Sheets

(51) Int. Cl.

| | |
|---|---|
| ***E02D 27/14*** | (2006.01) |
| ***E04H 12/22*** | (2006.01) |
| ***E04H 17/08*** | (2006.01) |
| ***E04H 17/22*** | (2006.01) |

(56) References Cited

U.S. PATENT DOCUMENTS 565,966 A * 8/1896 Deck ..... F16G 11/12 256/37
1,161,865 A * 11/1915 Jones et al. ..... E04H 17/08 52/150
2,046,152 A * 6/1936 Dean ..... E04C 3/30 52/301
2,699,321 A * 1/1955 Nelson ..... E21B 15/02 175/9
2,778,140 A * 1/1957 Applegate ..... A01K 79/02 43/17.1
2,841,367 A * 7/1958 Funk ..... E04H 17/08 256/37
3,846,991 A * 11/1974 Wisotsky ..... E02B 17/02 173/1
4,377,352 A * 3/1983 Goodstein ..... E02B 7/20 405/115
4,921,373 A * 5/1990 Coffey ..... E02B 7/16 405/91
5,301,925 A * 4/1994 Carlson ..... E04H 17/06 256/13
5,579,794 A * 12/1996 Sporta ..... E04B 1/34347 135/90
5,775,037 A * 7/1998 James ..... F16G 11/02 52/166
5,904,446 A * 5/1999 Carlinsky ..... E02D 27/32 52/169.9
6,079,904 A * 6/2000 Trisl ..... E02B 3/106 405/116
6,196,764 B1 * 3/2001 Bayssiguier ..... E02B 7/20 405/102
7,607,864 B2 * 10/2009 Kenady ..... B63B 35/44 405/196
9,670,633 B1 * 6/2017 Thieding ..... E02B 3/102
9,771,699 B2 * 9/2017 Mulvihill ..... E02B 3/106
2007/0237585 A1 * 10/2007 Frantz ..... E02B 7/44 405/107
2011/0033237 A1 * 2/2011 Kanand ..... E02D 17/20 405/17
2012/0163917 A1 * 6/2012 Waters, Jr. ..... E02B 3/102 405/114
2013/0209173 A1 * 8/2013 Quek ..... E05F 15/627 405/87
2019/0345684 A1 * 11/2019 Kimura ..... E02B 7/44
2020/0340649 A1 * 10/2020 Oliver ..... E04H 12/2261
2021/0285175 A1 * 9/2021 Ward ..... E02B 3/106
2022/0003011 A1 * 1/2022 Coates, Jr. ..... E04H 12/30
2022/0120108 A1 * 4/2022 Harris ..... E04H 9/145

FOREIGN PATENT DOCUMENTS

| | | | |
|---|---|---|---|
| AU | 79162/94 | B | 12/1996 |
| DE | 20 2004 020 635 | U1 | 10/2005 |
| EP | 2 365 134 | A2 | 9/2011 |
| NO | 138259 | B | 3/1977 |
| NO | 20170313 | A1 | 3/2018 |
| WO | WO 2004/016860 | A1 | 2/2004 |

OTHER PUBLICATIONS

International Bureau, Written Opinion of the International Searching Authority in International Application No. National Phase of PCT/NO2019/050243, mailed Jan. 14, 2020.

* cited by examiner

GROUND-ANCHORED FOUNDATION FOR A MOBILE FLOOD PROTECTION ARRANGEMENT AND FLOOD PROTECTION ARRANGEMENT FOR ATTACHMENT TO A GROUND-ANCHORED FOUNDATION, AS WELL AS METHOD FOR ANCHORING A MOBILE FLOOD PROTECTION ARRANGEMENT

CROSS-REFERENCE TO RELATED APPLICATIONS

This patent application is the U.S. National Stage of International Patent Application No. PCT/NO2019/050243, filed Nov. 6, 2019, which claims the benefit of Norwegian patent application Ser. No. 20/181,452, filed Nov. 13, 2018, which are each incorporated by reference.

FIELD OF THE INVENTION

The present invention relates to a ground-anchored foundation for a mobile flood protection.

BACKGROUND

With the risk of rapidly rising floods in densely populated areas, there are today an increasing number of areas that are exposed to being damaged by floods. This happens regularly in Norway and abroad, and every year floods causes great damage.

Conventionally, buildings are protected by sandbags. This is a time-consuming process that requires a large number of people to set up, and it is often not possible to erect a sandbag wall in time.

There exists mobile flood protection arrangements that can be set up by laying out prefabricated elements that are inserted into the ground, as described in WO 2004/016860 A1. The disadvantage of such flood protection is that it is not securely anchored to the ground, as it cannot withstand horizontal and vertical forces, and will therefore succumb to high water pressure. A solid ground anchorage is therefore essential for a safe and well-functioning protection against flood.

Other prefabricated flood defenses, such as described in NO 20170313 A1 and EP 236513 4 A2, use boxes with retractable elements buried in the ground. Such a solution is not favorable as one must have a framework dug down. This means that the complex framework comprising movable parts lying in the ground for years, where it will be subjected to deteriorate. The installation costs of such a solution will also be substantial.

Therefore, there is a need for a quick-built flood protection that can be quickly set up at various heights and on uneven grounds at different levels, securely anchored to the ground and which is inexpensive to install.

With the ground anchoring arrangement of the present invention described herein, the disadvantages and limitations described above are avoided and further advantages are obtained with the invention as described with the features set forth below and in the claims.

SUMMARY

The present invention provides a device for use with other flood protection equipment, more specifically, a combination of equipment which enables rapid construction and anchoring of a mobile flood protection arrangement. In order to quickly set up a flood protection, a ground-based foundation for a mobile flood protection is disclosed herein, wherein the ground-anchored foundation comprises at least one bottom anchor cylinder, wherein the at least one cylinder is attached to a plate, the plate being centered to the at least one cylinder, wherein the plate comprises a mounting hole adapted for pivotally attaching a receiver part to the mobile flood protection unit. The plate further comprises a protrusion jutting vertically upwardly, and where the protrusion has an upper end approximately flush or planar with the surface of the ground, and wherein the mounting hole is located in the protrusion a predetermined distance from the upper end of the protrusion.

In one embodiment of the invention, the cylinder is oriented approximately vertically upright or inclined.

In another embodiment, the invention comprises a second ground anchor cylinder in which the second cylinder is attached to the plate.

In a further embodiment, the plate is a vertical plate having a substantially rectangular body having a width and a height, and a protrusion jutting vertically upwards from the main part a predetermined height.

The second aspect of the invention relates to a mobile flood protection for attachment to a ground anchored foundation. Where flood protection comprises a receiver part, a vertical wall support pillar protruding upwards from the receiver part, a horizontally placed profile protruding approximately perpendicularly from the receiver part and which is bearingly supported on the ground at its free end, a support profile obliquely situated and fastened at a first end to the wall support pillar and at a second end to the horizontally placed profile. The wall support pillar comprises at least one fastening means, wherein a cladding plate panel is provided which is attached to the wall support pillar using the at least one fastening means, and wherein the cladding plate panel is adapted to withstand flood water.

In a preferred embodiment of the flood protection, the receiver part comprises a slit adapted for the protrusion of the plate, a hole adapted for a receiving a bolt, and a bolt. The bolt is adapted to penetrate the bolt hole in the receiver part and the mounting hole in the plate when the receiver part is positioned with the slit over the plate in such a way that the bolt hole and the mounting hole correspondingly coincide.

The third aspect of the invention relates to a method of anchoring a mobile flood protection foundation according to one of the claims, in the ground. The process comprises the steps of:

a) to provide a hole in the ground, by digging or drilling,
b) placing at least one hollow cylinder with a slit, adapted to receive a carrier or plate at the upper end, down into the hole in the ground,
c) fill the hollow cylinder with concrete,
d) placing the plate in the slit of the at least one concrete-filled cylinder in a position where the upper end of a protrusion is in alignment or in plane with the surface of the ground and where the horizontal position of the plate is adapted to the placement and positioning of a mobile flood protection arrangement.

The fourth aspect of the invention relates to a method of mounting a mobile flood protection, in which a plurality of ground anchored foundations according to one aspect of the invention are arranged adjacent to one another, or adjacent to each other, at a predetermined distance in the ground. The method comprises:

a) attaching a section of a mobile flood protection arrangement according to claim 5 to a first ground anchored foundation, b) attaching a new section of a mobile flood protection according to claim 5 to a second ground anchor adjacent to the first ground anchor foundation, c) Repeat step a) and b) until the desired length of flood protection is achieved.

BRIEF DESCRIPTION OF THE DRAWINGS

For a better understanding of the invention, a set of figures is provided. Equal numbers on different figures describe the same traits.

DETAILED DESCRIPTION OF THE INVENTION

The following invention enables an inexpensive, fast and secure installation of a ground-anchored foundation for a mobile flood protection arrangement. With the ground anchored foundations pre-installed in flood-exposed areas and around buildings, a flood protection system can be quickly set up by attaching a plurality of flood protection cements to the foundations when needed. The foundations will be ready for use for years without the risk of deterioration. If necessary, effective flood protection can be set up without a large number of people or expensive machines.

Compared to the prior art, the present invention is a safer, faster and cheaper solution.

When using words such as up, down, vertical, horizontal or inclined etc. this is always in relation to a foundation and a flood protection place on flat land.

Figure 1:
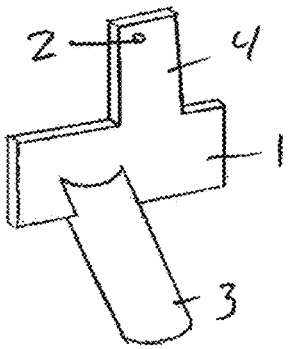
FIG. 1 shows the plate and the cylinder

FIG. 1 shows a cylinder 3 and a plate 1, the plate is a vertical girder, preferably in aluminum, steel or stainless steel. The plate 1 has a hole 2 for attaching a receiver part 5 to a mobile flood protection. The cylinder 3 is formed with a centered slit or recess adapted to receive the plate 1. By adapted, it is meant that the slit or recess has a width which is greater or equal to the thickness of the plate. The hole 2 in the figure is located to the side of the center line of the cylinder 3, but may also be placed in line with the center line of the cylinder 3.

In an advantageous method, the plate 1 is molded or cast in the cylinder 3.

Figure 2:
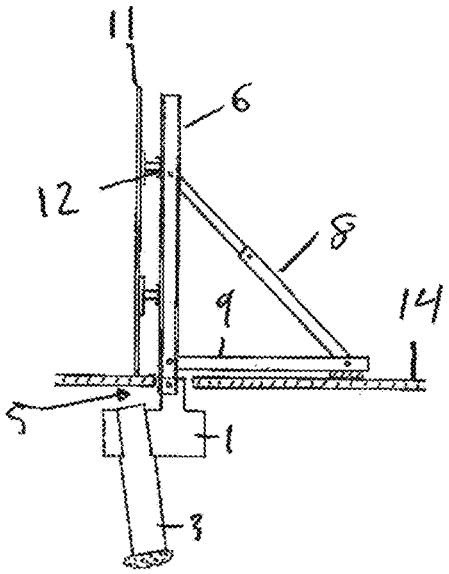
FIG. 2 shows the ground-anchored foundation mounted mobile flood protection

FIG. 2 shows the ground-anchored foundation below ground plane 14 with the upper end of the protrusion 4 approximately aligned with ground plane 14. In this example, a section of the mobile flood protection arrangement when attached to the ground-anchored foundation, is shown in a perspective view. The mobile flood protection arrangement comprises a lower receiver part 5 adapted to the foundation, a vertically positioned wall support pillar 6 protruding upward from the receiver part 5, a horizontally placed profile 9 protruding approximately perpendicularly from the wall support pillar 6, an oblique placed support profile 8 which is at a first end attached to the wall support pillar 6 and a at a second end is attached to the horizontal profile 9, wherein the wall support 6 comprises at least one fastening means 12, wherein there is provided cladding plate panel 11 which is attached to the wall support pillar 6 using the at least one fastening means 12, and where the cladding plate panel 11 is adapted to withstand flood water. The receiver part 5, the wall support pillar 6, the inclined support profile 8 and the horizontal profile 9 may have cross-sectional profiles which are round, rounded, rectangular, quadratic or other suitable cross-sections, which will be obvious to one skilled in the art.

Figure 3:
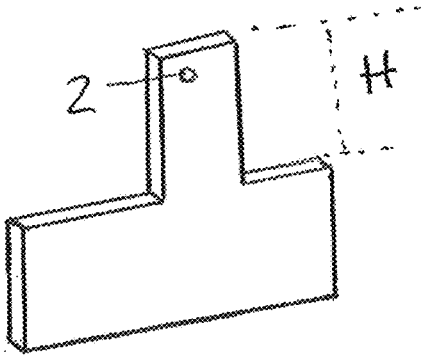
FIG. 3 shows the plate
Figure 4:
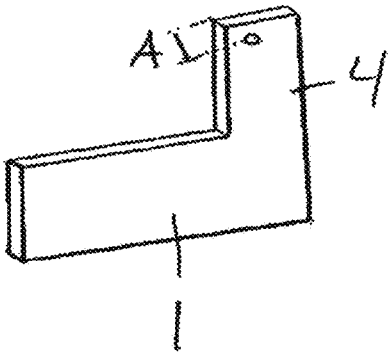
FIG. 4 shows the plate in an L embodiment

FIG. 3 shows the plate 1 in an embodiment where the protrusion 4 protrudes or juts from approximately the middle of the width to an approximately rectangular body. The main part is mainly elongated, that is, it has a width and a height, where the width is greater than the height. The protrusion may also project from one of the ends of the main part as shown in FIG. 4, so that plate 1 is L-shaped. In FIGS. 3 and 4, the protrusion protrudes a predetermined height H up from the main part. The purpose of the protrusion is to be able to anchor the cylinder 3 a distance below the ground surface and still provide a connection point for a mobile flood protection arrangement at the level of the ground surface 14. By varying the location of where the plate 1 is attached on the cylinder 3, it will be possible to achieve optimal placement of the connection point of the mobile flood protection arrangement.

The cylinder 3 and plate 1 is placed in the ground by preferred method. The protrusion 4 is optimally positioned when its upper end is aligned with, or in plane with the ground surface.

Figure 5:
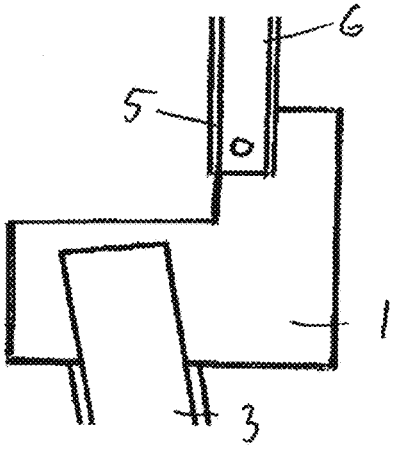
FIG. 5 shows the ground anchored foundation and the receiver part in profile

FIG. 5 shows the receiver part 5 as the lower part of the wall support pillar 6 of the mobile flood protection arrangement is attached to an upper end of the projection 4 and where the plate 1 is fixed in the cylinder 3.

Figure 6:
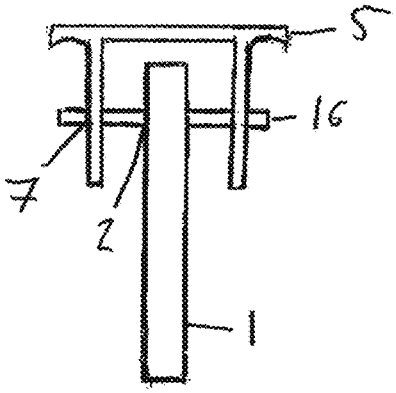
FIG. 6 shows the ground anchored foundation and receiver part

FIG. 6 shows the receiver part 5 which includes a slit 10 or recess adapted to the protrusion 4 of the plate 1, a bolt hole 7 in the receiver part, and a bolt 16, wherein the bolt is adapted to penetrate the bolt hole 7 in the receiver part and mounting hole 2 in the plate 1, when the receiver portion is positioned with the slit 10 above the plate in such a way that the bolt hole 7 and the mounting hole 2 corresponds. With such an assembly, a pivotal attachment is obtained between the plate 1 and the wall support pillar 6, in a fashion allowing the mobile flood protection arrangement to be tilted back or forth to achieve a construction perpendicular to the ground surface. By means of the slit 10 or recess at the lower end of the receiver part 5 being deeper than the height A from the hole 2 in the projection to the top of the upper end of the protrusion, a tolerance is obtained which makes the coupling of said elements swivelable, regardless of whether the cross-sectional profile of the wall support is round, rounded, rectangular or designed as an I-beam.

Figure 7:
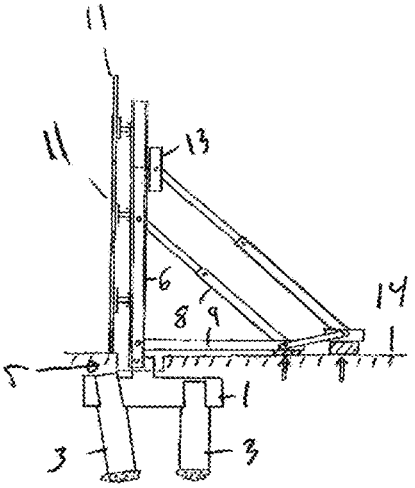
FIG. 7 shows two cylinders attached to the plate and an elevation of the cladding plate with associated additional support.

FIG. 7 shows an alternative embodiment of the invention in which the plate 1 is attached to, and anchored by, two cylinders 3. This may be advantageous in areas where high flooding can be expected, and the flood protection must be increased by additional cladding plate panels 11 and supported by an extra inclined support profile with mounted fishplate or splice bar 13. Said embodiment may also be advantageous in slopes or at the bottom of valleys in the terrain where one or more sections of mobile flood protection will be lower than adjacent sections of mobile flood protection.

Figure 8:
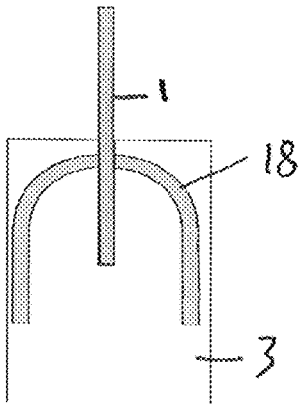
FIG. 8 shows the girder with suspended reinforcement

FIG. 8 shows an alternative export of the invention where a suspended reinforcement bar 18 is supplied through a hole in the plate 1 so that the molded or cast reinforcement bar 18 adds additional holding force between the plate 1 and the cylinder 3. In a non-illustrated example, other alternative the girder is equipped with grooves or ribs or other surface contours in the contact zone against the cylinder 3 to provide better adhesion between the concrete and the plate 1.

Figure 9:
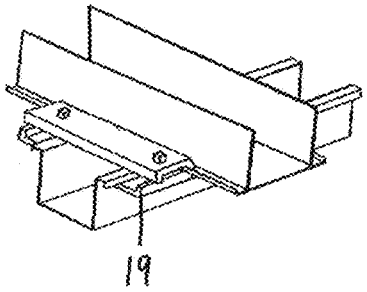
FIG. 9 shows a section of two cross-sectioned profiles fastened with profile clamp

FIG. 9 shows two crossed profiles coupled together with a profile clamp 19.

The clamp 19 can advantageously be used to hold profile bodies close together, where the different profiles form part of the mobile flood protection arrangement. The advantage is obtained by the fact that the connection is stepless and that the connection can be strengthened with multiple clamps 19 if needed. The clamp 19 is a strong and fast connected clamp that can connect two profiles to set up the mobile flood protection. Said profiles in the present embodiment may include all profiles shapes and elements that is comprises the mobile flood protection arrangement.

Figure 10:
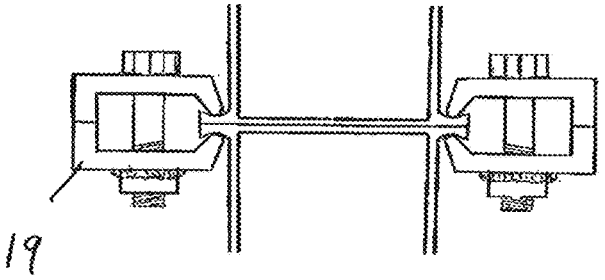
FIG. 10 shows a section of two matching profiles with profile clamp

FIG. 10 shows a section of the clamp 19 when it fastens together two parallel profiles or profiles with concurrent directions. The profile clamp consists mainly of two opposing c-profiles, which can be laid in a coincidental or transverse direction, and at least one tensioning device for tightening the c-profiles towards or against each other and obtaining a clamping force. For example, the tightening device may be a nut and bolt configuration.

Figure 11:
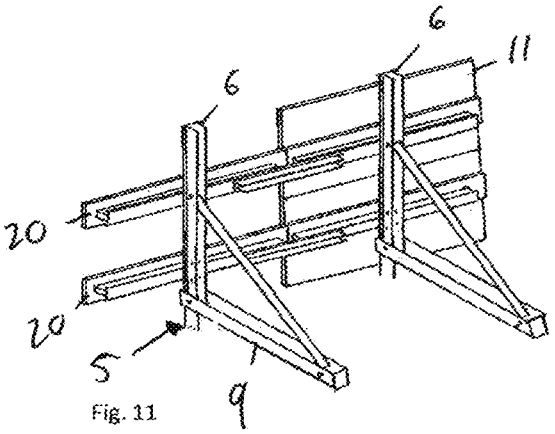
FIG. 11 shows the framework for two flood protection sections, one has a cladding plate

FIG. 11 shows the framework for two flood protection sections, one of which has a cladding plate panel 11. With a profiled fishplate girder or splice bar 17 over the section joints, flat and straight joint joints are obtained together with a reinforced beam bar between two flood protection sections.

Figure 12:
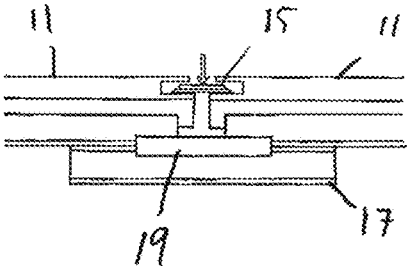
FIG. 12 is a sectional view of two adjacent cladding plates and seal

FIG. 12 shows a section of two adjacent facing cladding plate panels 11 with two adjacent horizontal plate holder profiles 20, where the two adjacent horizontal plate holder elements 20 are held together by a fishplate 17, and where a profile connection clamp 19 interconnects two adjacent horizontal plate holder profiles 20 and fishplate 17. A seal between the adjacent cladding plate panels 11 is obtained with a sealed joint 15.

Figure 13:
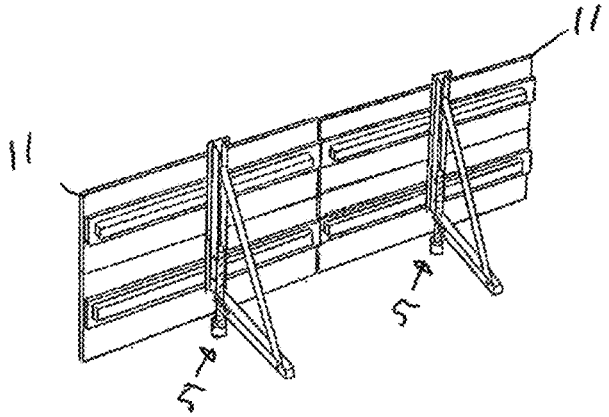
FIG. 13 shows two sections of a mobile flood protection attached to respective ground anchored foundations.

FIG. 13 shows two adjacent sections of mobile flood protection protruding from respective ground anchored foundations. Sections of flood protection are set up approximately next to each other according to the preferred method of forming a continuous flood protection.

Figure 14:
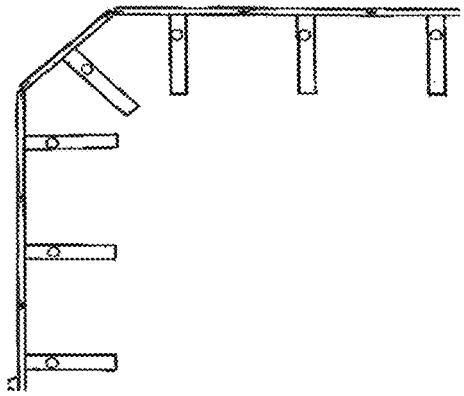
FIG. 14 shows a plurality of sections of a flood protection arrangement interconnected at an angle.

FIG. 14 shows from a bird's eye view of a layout of the mobile flood protection arrangement mounted on ground-anchored foundations with approximately equal spacing and where an angle of 90° is obtained by having several sections of the flood protection having an adjacent angle of 45°. The ground-based foundations can thus be placed with a variety of angles to obtain a flood protection that follows terrain or buildings.

In order to anchor a ground-anchored foundation according to the invention in the ground in a cheap and fast way, one can first provide by digging or drilling, a hole in the ground. A time and cost-effective way to provide one or more holes in the ground is to use earth drills. The depth of the hole is determined by the required length of the cylinder 3 to obtain sufficient adhesion. Furthermore, at least one hollow cylinder is placed in the provided hole. This cylinder is preferably made of a hard plastic material. The cylinder is formed with a centered slit or recess at its upper end, the width and depth of the slit or recess is dimensioned so that it is adapted to receive a plate 1 to be placed in the slit or recess. Further, the hollow cylinder is filled with concrete up to the upper end of the cylinder and a plate 1 is placed in the slit or recess. The plate 1 can then be adjusted in the height and longitudinal direction to achieve the desired position. Upon curing or hardening of the concrete, the plate 1, embedded in the cylinder, is fixatedly fastened. In the stored, or unused condition, the visible part of the ground anchor is limited to only the top of the protrusion 4. This applies regardless of whether the ground level at its surface, such as asphalt, has different height levels or if the ground is a hill or hilly. The mounting mechanisms and the hole in the ground left from the ground anchors can be covered with a lid or other protective means. Unique with pipe foundations is that several foundations can be built simultaneously and with the same work operations. Particularly favorable is this method of measurement for fastening wall supports, besides that all concrete labor can then be carried out on several foundations at the same time.

The cylinder 3 may be positioned at an oblique or inclined angle down in the ground to resist the forces acting in a vertical direction upwards from the ground. An inclined cylinder 3 will be blocked from being pulled straight up by the ground or earth above it. Such upward forces may occur if the flood water is high on the cladding plate panel 11. The ground-anchored foundation will also be subjected to horizontally directed forces from the water pressure. A sufficiently long cylinder will withstand the horizontal forces. With a mobile flood protection arrangement attached to a ground-anchored foundation as disclosed, the inclined profiles get a vertically directed pressure and a high resistance to settling or sinking in the soil or ground, when the arrangements stops the flood.

Although specific embodiments of the invention have been disclosed and illustrated herein, it is known that modifications and variations may readily occur to those skilled in the art, and accordingly, the claims are intended to be interpreted to cover such modifications and equivalents.

REFERENCE NUMERALS

1 Plate
2 Hole in plate
3 Cylinder
4 Protrusion
5 Receiver part
6 Wall support pillar
7 Hole for locking bolt in the receiver part
8 Inclined support profile
9 Horizontal profile
10 Slit
11 Cladding plate panels
12 Fastening means

13 Fishplate or splice bar
14 Surface of the ground
15 Sealed joint
16 Bolt
17 Fishplate girder
18 Reinforcement bar
19 Clamp
20 Horizontal style plate-holding profiles

The invention claimed is:

1. A mobile flood protection arrangement for attachment to a mobile flood ground-anchored foundation, the mobile flood ground-anchored foundation comprising:

a cylinder anchored down in the ground, wherein the cylinder is attached to a plate centrally attached to the cylinder, wherein the plate is a vertically positioned plate having a substantially rectangular main part having a width and a height, the width of the main part being greater than the height, and comprises a mounting hole adapted for pivotally attaching a receiver part of the mobile flood protection arrangement, wherein the plate further comprises a protrusion jutting vertically upwardly, and where the protrusion has an upper end approximately flush or planar with the surface of the ground, and the protrusion juts vertically upwards from the main part to a predetermined height (H), and wherein the mounting hole is located in the protrusion a predetermined distance (A) from the upper end of the protrusion;

the mobile flood protection arrangement further comprising:

a receiver part, a vertical wall support pillar protruding upwards from the receiver part, a horizontally placed profile protruding approximately perpendicularly from the receiver part and which is bearingly supported on the ground at a free end of the horizontally placed profile, a support profile obliquely situated and fastened at a first end to the wall support pillar and at a second end to the horizontally placed profile, wherein the wall support pillar comprises at least one fastening means, wherein a cladding plate panel is provided which is attached to the wall support pillar using the at least one fastening means, and wherein the cladding plate panel is adapted to withstand flood water.

2. The mobile flood protection arrangement according to claim 1, wherein the cylinder is oriented approximately vertically upright or inclined.

3. The mobile flood protection arrangement according to claim 1, that further comprises a second cylinder anchored down in the ground, wherein the second cylinder is attached to the plate.

4. The mobile flood protection arrangement according to claim 1, wherein the receiver part comprises:

a slit adapted for the protrusion of the plate, a bolt hole adapted for a bolt, and a bolt, wherein the bolt is adapted to penetrate the bolt hole in the receiver part and the mounting hole in the plate when the receiver part is positioned with the slit over the plate in such a way that the bolt hole and the mounting hole correspondingly coincide.

5. A method for anchoring a foundation for the mobile flood protection arrangement according to claim 1 in the ground, wherein the method comprises:

a) providing a hole in the ground, by digging or drilling, b) placing at least one hollow cylinder with a slot, adapted to receive a carrier or the plate at the upper end, down into the hole in the ground, c) filling the at least one hollow cylinder with concrete, d) placing the plate in the slot of the at least one concrete-filled cylinder in a position where the upper end of the protrusion is in alignment or in plane with the surface of the ground and where the horizontal position of the plate is adapted to the placement and positioning of a mobile flood protection arrangement.

6. A method for mounting the mobile flood protection arrangement of claim 1, wherein a plurality of ground-anchored foundations are arranged approximately adjacent to each other with a predetermined distance apart, in the ground, wherein the method comprises:

a) attaching a section of a mobile flood protection arrangement comprising:

a receiver part, a vertical wall support pillar protruding upwards from the receiver part, a horizontally placed profile protruding approximately perpendicularly from the receiver part and which is bearingly supported on the ground at a free end of the horizontally placed profile, a support profile obliquely situated and fastened at a first end to the wall support pillar and at a second end to the horizontally placed profile, wherein the wall support pillar comprises at least one fastening means, wherein a cladding plate panel is provided which is attached to the wall support pillar using the at least one fastening means, and wherein the cladding plate panel is adapted to withstand flood water to a first ground anchored foundation, b) attaching a new section of a mobile flood protection arrangement comprising a receiver part, a vertical wall support pillar protruding upwards from the receiver part, a horizontally placed profile protruding approximately perpendicularly from the receiver part and which is bearingly supported on the ground at a free end of the horizontally placed profile, a support profile obliquely situated and fastened at a first end to the wall support pillar and at a second end to the horizontally placed profile, wherein the wall support pillar comprises at least one fastening means, wherein a cladding plate panel is provided which is attached to the wall support pillar using the at least one fastening means, and wherein the cladding plate panel is adapted to withstand flood water to a second ground anchor foundation adjacent to the first ground anchor foundation, c) repeating step a) and b) until the desired length of mobile flood protection is achieved.

7. The method for mounting a mobile flood protection arrangement according to claim 6, wherein the method further comprises:

d) putting sealing or packing compound on the ground where the plates meet the ground.

8. The mobile flood protection arrangement according to claim 2, that further comprises a second cylinder anchored down in the ground, wherein the second cylinder is attached to the plate.

* * * * *